US006090214A

United States Patent [19]

Zhou et al.

[11] Patent Number: 6,090,214

[45] Date of Patent: Jul. 18, 2000

[54] CLEANING METHOD USING AMMONIUM PERSULPHATE TO REMOVE SLURRY PARTICLES FROM CMP SUBSTRATES

[75] Inventors: Dashun Steve Zhou, Sunnyvale; Solomon I. Beilin, San Carlos; James J. Roman, Sunnyvale, all of Calif.

[73] Assignee: Fujitsu Limited, Japan

[21] Appl. No.: 09/102,970

[22] Filed: Jun. 22, 1998

[51] Int. Cl.[7] ..... B08B 7/00

[52] U.S. Cl. ..... 134/6; 134/32; 134/34

[58] Field of Search ..... 134/6, 7, 32, 34, 134/902

[56] References Cited

U.S. PATENT DOCUMENTS

| | | | |
|---|---|---|---|
| 3,954,498 | 5/1976 | Flowers | 134/2 |
| 4,481,071 | 11/1984 | Anderson et al. | 156/656 |
| 4,632,727 | 12/1986 | Nelson | 156/656 |
| 4,817,652 | 4/1989 | Liu et al. | 134/102 |
| 5,030,373 | 7/1991 | Kimura et al. | 252/79.4 |
| 5,078,801 | 1/1992 | Malik | 134/29 |
| 5,130,275 | 7/1992 | Dion | 437/225 |
| 5,225,034 | 7/1993 | Yu et al. | 156/636 |
| 5,277,756 | 1/1994 | Dion | 156/664 |
| 5,320,706 | 6/1994 | Blackwell | 156/636 |
| 5,485,644 | 1/1996 | Shinbara et al. | 15/21.1 |
| 5,551,986 | 9/1996 | Jain | 134/6 |
| 5,607,718 | 3/1997 | Sasaki et al. | 427/97 |
| 5,624,501 | 4/1997 | Gill, Jr. | 134/6 |
| 5,626,681 | 5/1997 | Nakano et al. | 134/3 |
| 5,639,311 | 6/1997 | Holley et al. | 134/6 |
| 5,656,097 | 8/1997 | Olesen et al. | 134/1 |
| 5,684,660 | 11/1997 | Gray et al. | 360/126 |
| 5,704,987 | 1/1998 | Huynh et al. | 134/6 |
| 5,709,755 | 1/1998 | Kuo et al. | 134/1.3 |
| 5,735,963 | 4/1998 | Obeng | 134/3 |
| 5,846,336 | 12/1998 | Skrovan | 134/10 |
| 5,868,863 | 2/1999 | Hymes et al. | 134/28 |

*Primary Examiner*—Randy Gulakowski
*Assistant Examiner*—Saeed Chaudhry
*Attorney, Agent, or Firm*—Coudert Brothers

[57] ABSTRACT

A chemical mechanical cleaning method utilizes an ammonium persulphate solution with simultaneous mechanical brushing to remove residual slurry particles from copper surfaces. The pH of the solution is selected to electrostatically repel charged slurry particles from the copper surface.

18 Claims, 2 Drawing Sheets

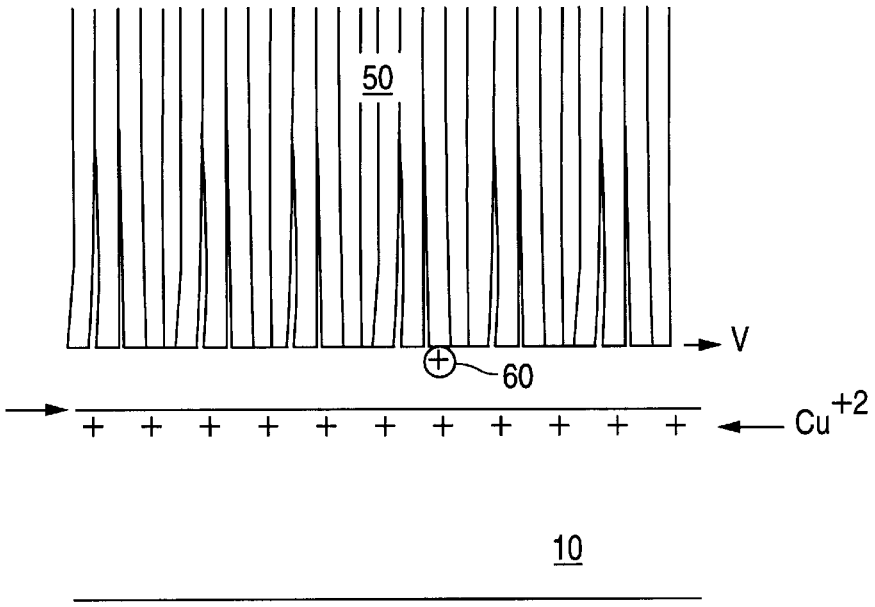
FIG. 4
FIG. 5
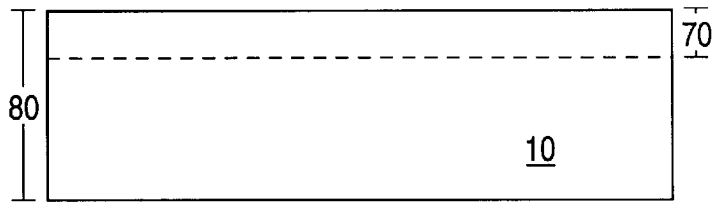
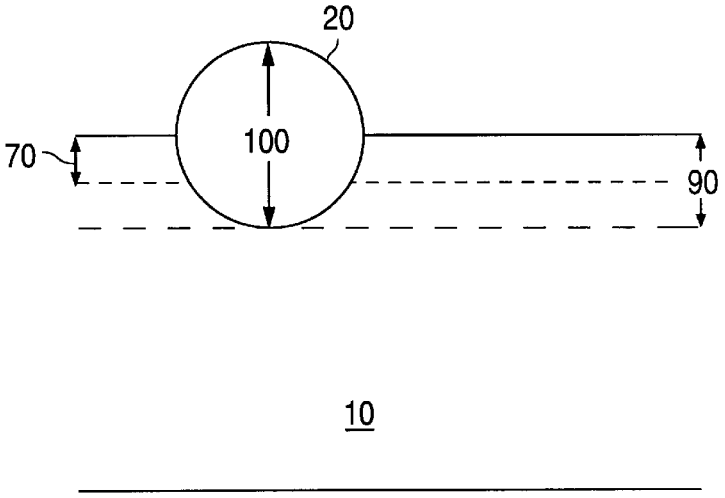
FIG. 6

CLEANING METHOD USING AMMONIUM PERSULPHATE TO REMOVE SLURRY PARTICLES FROM CMP SUBSTRATES

FIELD OF THE INVENTION

This invention relates generally to the cleaning of semiconductor wafers, and more particularly to a method of removing polishing slurry from copper interconnects after a chemical mechanical polishing process.

BACKGROUND OF THE INVENTION

Copper is a good electrical conductor and comparatively inexpensive. Copper interconnects are commonly used in semiconductor printed circuit boards and package mounts for integrated circuits. Recently, copper has also been used as both gate and interconnect layers to increase the speed of silicon integrated circuits.

In the fabrication of integrated circuits, complex interconnects are required to couple together different devices. However, a series of undesirable non-planar steps may be formed on the chip by the interconnects. To solve this problem, interconnect metallization layers are typically coated with a deposited dielectric layer and then the surface is planarized by using a chemical mechanical polishing process.

Chemical mechanical polishing (CMP) is becoming a more common process step for planarizing semiconductor wafers, although it can also be used to polish and planarize other surfaces as well. A CMP planarization process typically uses a polishing slurry comprised of a chemical etchant and an abrasive component, such as alumina or silica particles. In a CMP planarization process, the polishing pad type, force between pad and wafer, and slurry composition are adjusted so that raised surface features on the wafer that are in physical contact with the polishing pad experience greater mechanical etching from the abrasive components of the slurry.

The abrasive silica or alumina particles used in common CMP polishing slurries typically have a particle size in the range of a few tenths of a micron to several microns in diameter. After a chemical mechanical polishing process, the wafer is readily cleaning of the bulk film of polishing slurry coating the wafer during the CMP process. However, a microscopic surface layer of residual slurry particles may still remain on portions of the wafer surface even after the bulk film of slurry is rinsed away. These residual slurry particles often interfere with subsequent device processing and may reduce device reliability. Consequently, residual slurry particles that remain on the wafer surface after CMP are highly undesirable.

Subsequent to a CMP planarization process, a wafer needs to be cleaned of deleterious residues and contaminants from the CMP process. Post-CMP cleaning procedures used for silicon wafers coated with dielectric materials or common metallization layers include de-ionized water with citric acid or potassium hydroxide, with the option of adding surfactants. However, post-CMP cleaning processes for copper interconnects need to be developed that address the special problems of copper surfaces that are polished with a CMP process.

Experiments by the inventors of the herein described cleaning method using scanning electron microscopy, Auger, and energy dispersive x-ray analysis indicate that residual alumina particles remain adhered on a copper surface after a CMP process using an alumina slurry. The inventors have also determined that these alumina residues are a source of interconnect failure. However, the inventors have experimentally determined that many common cleaning procedures are ineffective at removing alumina particles from a copper surface subsequent to a CMP process utilizing an alumina slurry. Brushing while rinsing with water does not remove residual alumina particles from a copper surface. Brushing the wafer with a 6% citric acid solution was found to be ineffective for removing alumina particles from a copper surface. Similarly, brushing a copper surface with a KOH solution was also found to be ineffective for removing alumina particles.

The inventors believe that alumina particle residues which remain on copper surfaces subsequent to a CMP process may cause both reliability and yield problems. The inventors have determined that alumina particle residues that are left on copper interconnects tend to cause breakage of copper interconnects. Alumina particle residues are thus a potential reliability problem for copper interconnects. Additionally, embedded slurry particles tend to reduce the yield of subsequent semiconductor fabrication processes. The inventors' experiments indicate that alumina particle residues may induce cracks in subsequently deposited thin (e.g., 200 Angstroms) seed layers which are commonly used for electrodeposition processes, thereby lowering the yield of such processes.

A post-CMP cleaning process for copper interconnects should effectively remove residual slurry particles from all copper surfaces, but without stripping the interconnect metalization. Moreover, such a cleaning process should be consistent with a high-yield interconnect fabrication process. However, experiments by the inventors indicate that previously known surfactants and rinses which are commonly used to clean wafers after a CMP process are ineffective at removing residual alumina particles from a copper surface.

What is desired is a new method to effectively remove residual slurry particles from copper surfaces after a CMP planarization process performed on a wafer with copper interconnects.

SUMMARY OF THE INVENTION

The present invention is directed to a method of using a chemical mechanical process to remove chemical mechanical polishing residues from metal interconnects. Embedded slurry particles are removed by mechanical brushing of the wafer surface while the wafer is rinsed with a cleaning solution that etches the metal surface at a controlled rate and which is selected such that the residual particles do not electrostatically cling to the metal surface.

Residual slurry particles are removed from the surface of a copper interconnect layer by a combination of brushing and rinsing the surface with an ammonium persulphate cleaning solution. The concentration of the ammonium persulphate cleaning solution and the rinse time is selected to achieve controlled shallow etching of the copper surface. As noted, mechanical brushing of the wafer while the wafer is rinsed with the cleaning solution facilitates particle removal. The pH of the cleaning solution is further selected to increase the electrostatic repulsion of residual slurry particles from the copper surface.

The cleaning process may be selected such that residual slurry particles are removed from copper interconnects while substantially preserving the thickness of the copper interconnect metallization layer. A cleaning rinse comprised of an ammonium persulphate solution with a concentration of 7% or less and a pH between ten-to-thirteen effectively cleans residual alumina and silica slurry particles while removing 0.1 microns or less of the copper surface. In one embodiment, the cleaning time of the process is selected such that less than about 0.2 microns of copper is removed from an interconnect layer during the cleaning process. In another embodiment, the cleaning time is selected such that less than about one-quarter of the initial copper thickness is removed during the cleaning process. In still another embodiment, the cleaning time is selected such that the thickness of copper removed from the interconnect layer during the cleaning process is less than about one-quarter the diameter of the residual slurry particles.

BRIEF DESCRIPTION OF THE DRAWINGS

FIG. 4 is a side view drawing showing how positively charged slurry particles may be electrostatically repelled from a positively charged copper surface.

FIG. 5. is a side view drawing showing embodiments of the present invention in which the cleaning process removes a comparatively small thickness of copper from copper interconnect layers.

FIG. 6 is a side view drawing showing an embodiment of the present invention in which the cleaning process removes a comparatively small thickness of copper compared to the depth to which slurry particles are initially embedded in the surface of copper interconnect layers.

DETAILED DESCRIPTION OF THE INVENTION

The method of the present invention is described in particular detail with regards to a cleaning procedure useful for cleaning residual alumina particles from a copper surface that has undergone a chemical mechanical polishing (CMP) process utilizing a polishing slurry comprised of alumina. However, the inventors believe that the method of the present invention is generally applicable to cleaning other types of abrasive slurry particles which comprise a CMP polishing slurry used to polish a copper surface.

Figure 1:
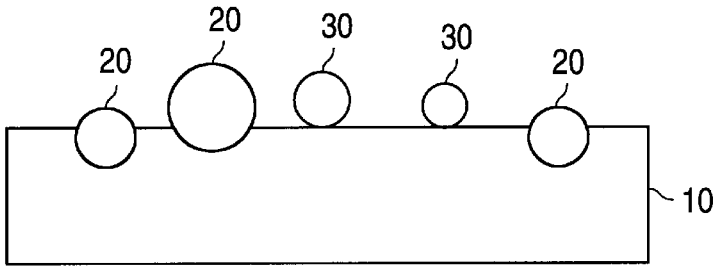
FIG. 1 is a side view drawing showing alumina slurry particles either resting on top of or partially embedded onto a copper surface after chemical mechanical polishing.

The inventors' studies have led them to believe that alumina particles are difficult to remove from copper surfaces for two key reasons. The inventors' experiments indicate that alumina particles may become embedded in a copper surface during a CMP planarization process. Copper is a relatively soft, malleable metal and a CMP process presses the slurry onto the wafer with substantial pressure and mechanical force. FIG. 1 is a side view drawing of alumina particles adhering to a copper surface after a CMP process utilizing an alumina slurry. As shown in FIG. 1, deeply embedded alumina particles 20 are mechanically attached to the surface of copper layer 10, and thus prove difficult to remove with common surfactants and brushing techniques. Additionally, a post-CMP copper surface may also have an initial concentration of loosely adhered alumina particles 30 resting on the surface.

Figure 2:
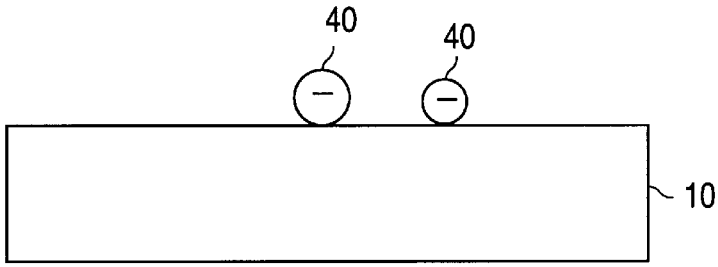
FIG. 2 is a side view drawing showing charged alumina particles clinging to a copper surface as a consequence of electrostatic attraction.

Additionally, the inventor's experiments have led them to believe that residual alumina particles from the slurry may also adhere to a copper surface because of electrostatic attraction. This is because a zeta potential, corresponding to a layer of positive or negative charge surrounding a residual slurry particle, may be created because of the interaction of the cleaning solution and the residual slurry particle. The inventors' experiments indicate that a zeta potential problem may occur for alumina particles on a copper surface. Depending upon the pH of the cleaning solution, alumina particles may become positively or negatively charged with respect to the copper surface. FIG. 2 is a side view drawing showing alumina slurry particles that are electrostatically attracted to the copper surface. As shown in FIG. 2, alumina particles 40 may cling to the surface of a copper layer 10 by the force of electrostatic attraction.

Figure 3:
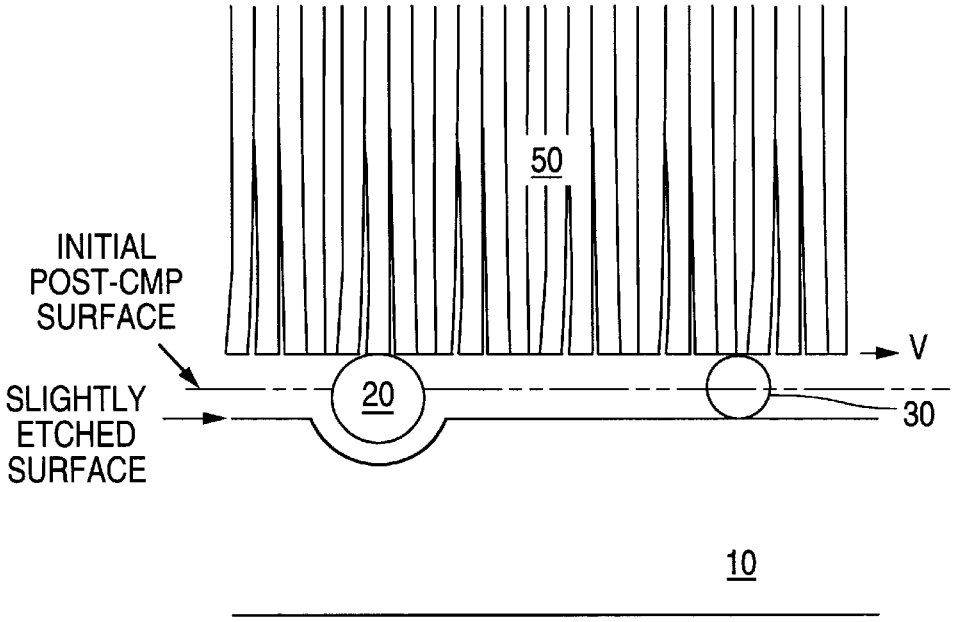
FIG. 3 is a side view drawing showing how the removal of partially embedded slurry particles from a copper surface is facilitated by a combination of mechanical agitation and chemical etching.

In the present invention the removal of alumina particles is achieved by simultaneously brushing the wafer surface while it is rinsed with an ammonium persulphate solution. FIG. 3 is a side view drawing showing how chemical etching and mechanical action facilitate the removal of embedded alumina particles. As shown in FIG. 3, the inventors believe that slight etching of the copper surface by the ammonium persulphate solution assists in releasing embedded slurry particles 20 from the outer surface of copper layer 10 by undercutting the copper surrounding embedded slurry particles 20. Also, the inventors believe that mechanical energy coupled from a brush 50 facilitates removal of adhered slurry particles 30 and embedded slurry particles 20. According to the teaching of the present invention, it is desirable that the brush couples mechanical energy to residual embedded slurry particles in order to facilitate their removal from the surface of the copper interconnects. However, the contact pressure between the brush and the substrate along with the relative velocity of the brush with respect to the substrate should be selected to prevent deleterious damage to the wafer surface. Those skilled in the art of semiconductor processing are knowledgeable regarding maximum brush pressures, substrate rotation speed, and brush rotation speeds that can be safely applied to a substrate surface with different types of brushes without damaging the surface of the substrate.

Additionally, the inventors believe that the pH of the ammonium persulphate solution may be adjusted to create a repulsive electrostatic force between the copper surface and slurry particles adhering to the surface of the copper. It is believed by the inventors that a copper surface in contact with an ammonium persulphate solution with a pH of ten-to-thirteen is positively charged by the production of $Cu^{+2}$ on the copper surface. It is also believed by the inventors that alumina slurry particles immersed in an ammonium persulphate solution in the same pH range have a zeta potential which produces a positive surface charge on the alumina particle. Consequently, positively charged alumina slurry particles experience a repulsive electrostatic force from the positively charged copper surface that facilitates the removal of alumina particles from the surface of the copper. FIG. 4 is a side view drawing showing how slurry particles that are charged the same as a metal layer are repelled from a metal surface. As shown in FIG. 4, a positively charged slurry particle 60 is electrostatically repelled from a positively charged surface of copper layer 10 such that it may be readily removed by brush 50. Additionally, there may also be an electrostatic attraction between the brush and the slurry particles.

The inventors have conducted several experimental tests of the inventive cleaning procedure on copper layers coating an entire substrate surface and upon copper interconnect layer structures. A cleansing rinse comprised of a 7% by weight ammonium persulphate in de-ionized water was used. The pH of the cleansing rinse was in the range of ten-to-eleven. The substrate was rotated on a conventional chuck at 200 RPM during the cleaning process. A conventional wafer-cleaning brush comprised of a poly vinyl alcohol (PVA) open cell structure having a 90% porosity was used. The open cell structure facilitates particle capture by the brush as the brush is pressed against the wafer surface. During the inventors'experiments, the brush height of the PVA brush was adjusted such that the brush firmly contacted the surface while the rinse solution was applied to the wafer surface. However, the brush height was adjusted such that it did not scratch the wafer surface. During the cleaning procedure the brush was rotated around its axis at a rotation rate of 15 RPM to facilitate particle removal and was translated back and forth relative to the wafer surface a distance of 0.1 inches at a rate of 2.0 inches per second. The chemical mechanical cleaning process was continued for 66 seconds. The corresponding thickness of copper removed from the copper layer 10 was approximately 0.1 micron. Experimental measurements by the inventors using scanning electron microscopy, energy dispersive x-ray analysis, and Auger analysis indicate that alumina particles with a mean diameter in the range of 0.04 microns to 1.6 microns are effectively removed under these cleaning conditions.

Many variations of the described post-CMP cleaning process are within the scope of the present invention. Such variables as solution concentration, solution pH, solution temperature, solution flow rates, substrate rotation speed, brush rotation speed, brush structure, and cleaning time may be altered to adjust the cleansing procedure. For example, the concentration of the ammonium persulphate solution may be varied over a wide range. The inventors have achieved satisfactory result for an ammonium persulphate solution with a concentration in the range of 3%-to-7%. General, lower concentration solutions etch copper at a slower rate. This may be desirable in some processes to increase the control over the cleaning process and/or to increase the relative importance of the mechanical aspects of the cleaning process.

Generally, it is desirable to select the parameters of the inventive post-CMP cleaning process such that a substantial fraction of the residual slurry particles are removed from the copper interconnect while a substantial thickness of the copper interconnect layer is retained. FIG. 5 is a side view drawing showing a copper interconnect layer which is to be etched. As shown in FIG. 5, several different criteria are of particular relevance. One criteria is that the etched thickness 70 corresponds to only a comparatively small fraction of the initial copper thickness 80 of copper layer 10. This criteria may be desirable to facilitate maintaining the resistance of copper interconnect layers within a desired range. For example, in some applications it is desirable to maintain control of the electrical resistance of copper interconnects to within 25% (e.g., many common electronic circuits are designed with resistance tolerances of less than 25%). Since the electrical resistance of a copper interconnect is proportional to its thickness, a cleaning process in which less than about one-fourth of the thickness of the copper metallization layer is etched away is desirable for applications where the electrical resistance of the copper interconnect must be controlled to less than about 25%. Another criteria for a cleaning process is that the etched thickness 70 is comparatively small. For example, a cleaning process in which less than 0.2 microns of copper is etched away is desirable in some applications.

FIG. 6 is a side view drawing showing a cleaning process in which a small thickness of copper is etched compared to the depth to which slurry particles are initially embedded in the copper surface. As shown in FIG. 6, still yet another criteria for a cleaning process is that the etched thickness 70 is substantially less than the mean diameter 100 of partially embedded slurry particles 20. As shown in FIG. 6, a deeply embedded slurry particle 20 corresponds to one that is embedded to a depth corresponding to half of its diameter 90 (e.g., half of the particle is embedded in the copper). In a purely chemical process, embedded slurry particle 20 may be de-embedded when the etched thickness 70 is about one-half of the particle diameter 90 such that the copper is chemically etched away from the entire surface of the embedded slurry particle. However, in the present invention, mechanical energy from the brush facilitates the removal of deeply embedded slurry particles. If the mechanical aspects of the cleaning process are equal in importance to the chemical aspects, then it can be expected that only half as much copper would need to be etched to de-embed slurry particles compared to a purely chemical removal process. Thus, another criteria for a chemical mechanical cleaning process is that the etched thickness 70 of copper removed is less than about one-quarter of the diameter 100 of embedded slurry particles.

A wide process window is possible with the method of the present invention. Using the teachings of the present invention, a process engineer selects the concentration of the ammonium persulphate solution to be used as a cleaning rinse. The maximum rinse cycle time may then be calculated based upon the maximum thickness of copper which may be removed from the surface (i.e., the rinse cycle time is the maximum acceptable reduction in copper thickness divided by the copper etch rate of the solution). Other process parameters, such as substrate rotation rate and brush pressure, may then be selected to achieve the desired mechanical component of the cleaning process. There are tradeoffs between the concentration of the ammonium persulphate solution and other parameters. For example, if a comparatively high concentration ammonium persulphate solution is used, the rinse time should be reduced to achieve the same reduction in copper thickness as a lower concentration solution. This reduces the cleaning time, which may be desirable. However, it also reduces the potential mechanical contribution to the cleaning process. For example, a cleaning process utilizing a comparatively high concentration ammonium persulphate solution for a brief length of time (e.g., a process in which 0.05 microns of copper is removed in 20 seconds) may have less mechanical cleaning than a process utilizing a comparatively low concentration ammonium persulphate solution for a protracted length of time (e.g., a process in which 0.05 microns of copper is removed in 200 seconds).

The pH of the ammonium persulphate solution may also be varied over a wide range. Those skilled in the art are presumed capable of selecting the pH of the ammonium sulphate solution to achieve the desired electrostatic repulsion of slurry particles with respect to the copper surface using well-known empirical techniques. Generally, it is desirable to select the pH such that the electrostatic repulsion of slurry particles from the copper surface is enhanced consistent with other cleaning objectives. However, there may be tradeoffs with other polishing objectives. In some cases, a pH range in which the residual slurry particles do not cling to the surface (i.e., neutral particles or only slightly charged particles) may be desirable to achieve other cleaning objectives. However, according to the teachings of the present invention, additional mechanical energy may be required to effectively remove residual particles if the residual particles are not electrostatically repelled from the surface.

The method of the present invention may also be generalized to other types of slurry particles (e.g., silica slurry particles) by empirically varying the pH of the solution and/or measuring the zeta potential of the particles in order to achieve the desired electrostatic repulsion of slurry particles relative to the surface of the copper. For example, the inventors have used substantially the same cleaning conditions as described above to remove residual silica slurry particles with a mean diameter in the range of 0.05 microns to 1.5 microns. Those skilled in the art are familiar with other abrasive slurry particles used in a CMP process for which the method of the present invention is also applicable.

It is believed by the inventors that the chemical mechanical cleaning process of the present invention is not limited solely to the use of ammonium persulphate as the chemical etchant utilized in the cleaning procedure. Other copper etchants whose etch rate can be controlled and which can be used in conjunction with other chemical components to achieve the desired electrostatic repulsion of slurry particles from the copper surface may also be utilized.

It is also believed by the inventors that the method of the present invention is applicable to other metals as well. The teachings of the present invention may be applied to removing residual slurry particles from other metal surfaces by: 1) selecting a chemical etchant that etches the metal at a controlled rate; 2) selecting the cleaning time and brush parameters such that the mechanical aspects of the cleaning process are a significant component of the cleaning process; and 3) adjusting the chemical etchant parameters (e.g., controlling its pH) such that residual slurry particles do not cling to the metal surface because of the force of electrostatic attraction.

Preferably, the composition of the cleansing solution is adjusted such that slurry particles are electrostatically repelled from the surface of the metal. However, in some cases substantial charge neutrality (e.g., the solution parameters adjusted such that particles are not significantly attracted to the metal surface) may be acceptable. In particular, a process engineer may trade off solution conditions in which particles are strongly electrostatically repelled from a metal surface (e.g., high pH) for those in which the particles are only weakly repelled from a metal surface (e.g., low pH) to achieve other objectives (e.g., improved control of the etching of metal layers). For example, a process engineer might choose a pH range where residual slurry particles are only weakly repelled from the surface and increase the mechanical component of the cleaning process to achieve the desired removal of residual slurry particles.

It is noted that the present invention utilizes the simultaneous interaction of three physical mechanisms to remove embedded slurry particles. The inventors believe that it is the combined effect of these three mechanisms that has enabled the inventors to achieve a cleaning method which removes residual slurry particles from copper interconnects while substantially preserving the thickness of the copper interconnect metallization layer. One aspect of the chemical mechanical cleaning process of the present invention is that the cleaning solution slightly etches the surface of the copper, which facilitates the removal of embedded slurry particles. However, etching alone is ineffective at removing alumina particles subsequent to the CMP of a copper interconnect layer. Experiments by the inventors in which a post-CMP copper surface was only dipped in a 7% ammonium persulphate solution proved ineffective at removing alumina particles, even if the etching was continued until 1.5 microns of copper was removed from the substrate. The present invention utilizes mechanical brushing and a cleaning solution with a pre-selected pH to assist in the removal of embedded particles. However, experiments by the inventors indicate that common acidic and alkaline solutions, such as those composed of citric acid or KOH, do not remove embedded slurry particles from copper surfaces even if the wafer is simultaneously brushed.

In summary, the present invention is a chemical mechanical cleaning process to remove residual embedded chemical mechanical polishing slurry particles from a metal surface. The present invention utilizes a combination of controlled chemical etching of the metal surface, adjustment of solution parameters (e.g., pH) to prevent electrostatic clinging of residual particles to the metal surface, and brushing to facilitate mechanical removal of embedded residual slurry particles from a metal surface.

Although a preferred embodiment of the present invention and modifications thereof have been described in detail herein, it is to be understood that this invention is not limited to those precise embodiments and modifications, and that other modifications and variations may be affected by one of ordinary skill in the art without departing from the spirit and scope of the invention as defined in the appended claims.

What is claimed is:

1. A method of cleaning a slurry residue from a surface of a copper layer, the copper layer disposed on a substrate which has been polished with a slurry composed of abrasive particles, comprising the steps of:

a) bringing a brush into contact with the surface of the substrate;

b) providing a relative motion between said brush and said substrate;

c) exposing the substrate to a rinse solution comprising de-ionized water and ammonium persulphate while the substrate is in contact with said brush; and d) continuing step "c" until the slurry residue is removed from the copper layer;

wherein the composition of the rinse solution is selected to undercut the abrasive particles residing on the surface of the copper layer and the pH of the rinse solution is selected so that the abrasive particles do not electrostatically cling to the surface of the copper layer.

2. The method of claim 1, wherein said rinse solution comprises not more than a 7% by weight solution of ammonium persulphate.

3. The method of claim 1, wherein said rinse solution has a pH in the range of ten to thirteen.

4. The method of claim 1, wherein the copper layer has an average thickness relative to the substrate, and wherein the substrate is exposed in step "d" to said rinse solution for a period of time which decreases said average thickness by less than one-fourth of said average thickness of said copper layer.

5. The method of claim 1, wherein said abrasive particles have an average diameter, and wherein the substrate is exposed in step "d" to said rinse solution for a period of time which etches the copper layer by a thickness that is less than one-fourth of said average particle diameter of said abrasive particles.

6. The method of claim 1, wherein the substrate is exposed in step "d" to said rinse solution for a period of time which reduces the thickness of the copper layer by an amount that is less than 0.2 microns.

7. The method of claim 1, wherein said rinse solution is sprayed onto the surface of the substrate.

8. The method of claim 1, wherein the brush is rotated while the substrate is cleansed.

9. A method of cleaning residual slurry particles from a copper metallization layer disposed on a substrate which has been polished, comprising the steps of:

a) selecting a rinse solution having an ammonium persulphate concentration such that the rinse solution etches the copper metallization layer at a preselected rate, thereby undercutting the slurry particles;

b) selecting a rinse cycle time;

c) adjusting the pH of the rinse solution such that the slurry particles are electrostatically repelled from the surface of the copper metallization layer;

d) bringing a brush into proximity with the surface of the substrate;

e) adjusting the position of the brush such that the brush is in physical contact with the substrate;

f) providing a relative motion between the brush and the substrate such that the brush couple mechanical energy to the slurry particles on the surface of the copper metallization layer; and g) exposing the substrate to the rinse solution during the rinse cycle time while the brush couples mechanical energy to the surface of the copper metallization layer; whereby the slurry particles are removed from the surface of said copper metallization layer.

10. The method of claim 9, wherein the slurry particles are comprised of alumina.

11. The method of claim 9 wherein the slurry particles are comprised of silica.

12. The method of claim 9, wherein the ammonium persulphate concentration of the rinse solution and the rinse cycle time are selected such that the thickness of the copper metallization layer is reduced by less than 0.2 microns.

13. The method of claim 9, wherein the ammonium persulphate concentration of the rinse solution and the rinse cycle time are selected such that less than about one quarter of the thickness of the copper metallization layer is removed.

14. The method of claim 9, wherein the slurry particles have a mean diameter, and wherein the ammonium persulphate concentration of the rinse solution and the rinse cycle time are selected such that the thickness of the copper metallization layer is reduced by an amount that is less than about one-fourth of said mean diameter of the slurry particles.

15. A chemical mechanical method of cleaning embedded slurry particles from a copper metallization layer disposed on a substrate after a polishing process, comprising the steps of:

a) selecting a rinse solution such that the rinse solution etches the copper metallization layer at a controlled rate;

b) selecting a rinse cycle time such that the rinse solution undercuts the embedded slurry particles and the thickness of the copper metallization layer is substantially preserved;

c) adjusting the pH of the rinse solution such that the slurry particles do not electrostatically cling to the surface of the copper metallization layer;

d) bringing a brush into proximity with the surface of the substrate;

e) adjusting the position of the brush such that the brush is in physical contact with the substrate;

f) providing a relative motion between the brush and the substrate; and g) exposing the substrate to the rinse solution during the rinse cycle time while the brush couples mechanical energy to the surface of the substrate;

whereby the embedded slurry particles are cleaned from said copper metallization layer and the thickness of said copper metallization layer is substantially preserved.

16. The method of claim 15, wherein the rinse solution is composed of an ammonium persulphate solution having an ammonium persulphate concentration selected such that the thickness of the copper metallization layer is reduced by less than 0.2 microns.

17. The method of claim 15, wherein the rinse solution is composed of an ammonium persulphate solution having an ammonium persulphate concentration selected such that less than about one quarter of the thickness of the copper metallization layer is removed.

18. The method of claim 15, wherein the pH of the rinse solution is selected so that the slurry particles are electrostatically repelled from the surface of the copper metallization layer.

* * * * *

CERTIFICATE OF CORRECTION

PATENT NO: 6,090,214

DATED: July 18, 2000

INVENTOR(S): Dashun S. ZHOU, et al.

It is certified that error appears in the above-identified patent and that said Letters Patent are hereby corrected as shown below:

Column 9, line 21, delete the word "couple" between the words "brush" and "mechanical" and substitute therefor the word --couples--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*